US010933292B1

(12) United States Patent
Fuchs et al.

(10) Patent No.: US 10,933,292 B1
(45) Date of Patent: Mar. 2, 2021

(54) SPORTS TRAINING AID

(71) Applicant: Implus Footcare, LLC, Durham, NC (US)

(72) Inventors: Daniel C. Fuchs, Carlsbad, CA (US); Richard R. Huth, III, Encinitas, CA (US); Randall A. Yarborough, Studio City, CA (US)

(73) Assignee: Implus Footcare, LLC, Durham, NC (US)

( * ) Notice: Subject to any disclaimer, the term of this patent is extended or adjusted under 35 U.S.C. 154(b) by 0 days.

(21) Appl. No.: 16/541,441

(22) Filed: Aug. 15, 2019

(51) Int. Cl.
*A63B 69/00* (2006.01)
*A63B 69/34* (2006.01)

(52) U.S. Cl.
CPC ..... *A63B 69/34* (2013.01); *A63B 69/002* (2013.01)

(58) Field of Classification Search
CPC ..... A63B 69/34; A63B 69/002; A63B 2243/0025; A63B 69/00; A63B 69/345
USPC ..... 473/446, 438, 441, 442, 444, 422
See application file for complete search history.

(56) References Cited

U.S. PATENT DOCUMENTS 4,869,503 A * 9/1989 Grasso ..... A63B 63/00 473/444
5,437,590 A 8/1995 D'Alto
5,700,230 A 12/1997 Cardona
6,796,915 B2 9/2004 Getchell
6,866,595 B1 3/2005 Elder et al.
D539,373 S 3/2007 Cook
7,198,580 B2 * 4/2007 Elder ..... A63B 69/002 473/446
D550,313 S 9/2007 Elder
D565,135 S 3/2008 Elder
D579,504 S 10/2008 Elder
D591,369 S 4/2009 Elder
D603,003 S 10/2009 Elder
7,658,689 B2 2/2010 Crook, II
D611,556 S 3/2010 Elder
D614,709 S * 4/2010 Elder ..... A63B 63/06 D21/698

(Continued)

FOREIGN PATENT DOCUMENTS

EP 1697557 B1 12/2017
WO 2017135520 A1 8/2017
WO 2018199557 A1 11/2018

OTHER PUBLICATIONS

"D-MAN by SKLZ", At least as early as Jul. 25, 2019, 1 page.

(Continued)

*Primary Examiner* — Raleigh W Chiu
(74) *Attorney, Agent, or Firm* — Kilpatrick Townsend & Stockton LLP

(57) ABSTRACT

A sports training aid having a base member, a center pole secured to the base member, at least one body panel rotatably secured to the center pole, and a plurality of elastic legs connected between the at least one body panel and the base member. The at least one body panel is configured to rotate in a first direction about the center pole when impacted by an object, the at least one body panel rotating from an original position to a deflected position. The elastic legs are configured to cause the at least one body panel to rotate in a second direction, opposite to the first direction, when a force from the impact subsides, thereby returning the at least one body panel to the original position.

15 Claims, 7 Drawing Sheets

(56) References Cited

U.S. PATENT DOCUMENTS

| | | | | |
|---|---|---|---|---|
| D630,283 | S | 1/2011 | Elder | |
| 8,277,340 | B1 | 10/2012 | Devine | |
| 9,259,634 | B1 * | 2/2016 | Bouse | A63B 69/0071 |
| 9,616,308 | B2 * | 4/2017 | Gilman | A63B 63/004 |
| 9,931,555 | B1 * | 4/2018 | McCoy | A63B 69/0071 |
| D835,188 | S | 12/2018 | Driver | |
| 2005/0159250 | A1 * | 7/2005 | Elder | A63B 69/002 473/446 |
| 2006/0100040 | A1 * | 5/2006 | Spencer | A63B 21/4047 473/441 |
| 2009/0291781 | A1 * | 11/2009 | Caruso | A63B 69/002 473/444 |
| 2014/0011612 | A1 * | 1/2014 | Trombley | A63B 63/06 473/446 |
| 2014/0302969 | A1 * | 10/2014 | Chen | A63B 69/203 482/90 |
| 2015/0190693 | A1 * | 7/2015 | Gilman | A63B 63/06 473/446 |
| 2016/0074730 | A1 * | 3/2016 | Farrington | A63B 69/34 473/446 |
| 2017/0173432 | A1 * | 6/2017 | Lam | A63F 7/0668 |

OTHER PUBLICATIONS

"Free Kick Training Mannequin by Uber Soccer", At least as early as Jul. 25, 2019, 1 page.
"Pop up Defender by Powernet", At least as early as Jul. 25, 2019, 1 page.
"Soccer Wall by Soccer Innovations", At least as early as Jul. 25, 2019, 1 page.
"TOM (Training Opponent Mannequin) by Kwik Goal", At least as early as Jul. 25, 2019, 1 page.
Application No. PCT/US2020/046186, International Search Report and Written Opinion, dated Nov. 3, 2020, 10 pages.

* cited by examiner

SPORTS TRAINING AID

TECHNICAL FIELD

The disclosure herein generally relates to a sports training aid, and more particularly, to a sports training aid intended to imitate an object and allow a player to practice shooting, dribbling or passing a ball around or over the object.

BACKGROUND OF THE INVENTION

Soccer is a well-known sport that requires many different skills to play well. For example, players need ball shooting, dribbling, and passing skills, and many of these skills cannot be practiced by a lone player.

Shooting, dribbling and passing a soccer ball around or over opposing players are skills that must be practiced. It is for this reason that many coaches use training devices to help develop player skills. In particular, there have been developed a number of training devices that are intended to simulate an opposing player. Many of these training devices are in the form of a dummy, most of which however are static during soccer practice. Since the dummy forms do not move during practice, they are not very realistic and therefore have limited value. A practice dummy form would be far more useful if it were more representative of a real player. For instance, if the dummy form could move in response to the impact of a soccer ball, it would be a more effective practice tool.

The need therefore exists for a dummy form capable of mimicking a soccer player that is self-supporting, yet can be moved easily and quickly to a desired play field.

BRIEF SUMMARY OF THE INVENTION

One aspect of the disclosure relates to a sports training aid having a base member, a center pole secured to the base member, at least one body panel rotatably secured to the center pole, and a plurality of elastic legs connected between the at least one body panel and the base member. The at least one body panel is configured to rotate in a first direction about the center pole when impacted by an object, the at least one body panel rotating from an original position to a deflected position. The elastic legs are configured to cause the at least one body panel to rotate in a second direction, opposite to the first direction, when a force from the impact subsides, thereby returning the at least one body panel to the original position.

Another aspect of the disclosure describes a method of using a sports training aid having a base member, a center pole secured to the base member, at least one body panel rotatably secured to the center pole, and a plurality of elastic legs connected between the at least one body panel and the base member. The method includes causing the at least one body panel to be impacted by an object, rotating the at least one body panel in a first direction about the center pole when impacted by the object, the at least one body panel rotating from an original position to a deflected position, rotating and twisting the elastic legs about the center pole when rotating the at least one body panel about the center pole, and rotating and untwisting the elastic legs when the impact force from the object subsides, the elastic legs causing the at least one body panel to rotate in a second direction, opposite to the first direction, thereby returning the at least one body panel to the original position.

BRIEF DESCRIPTION OF THE DRAWINGS

These and other features, and advantages of the claimed invention will become more readily apparent to those skilled in the art upon reading the following detailed description, in conjunction with the appended drawings in which:

DETAILED DESCRIPTION OF THE INVENTION

Figure 1:
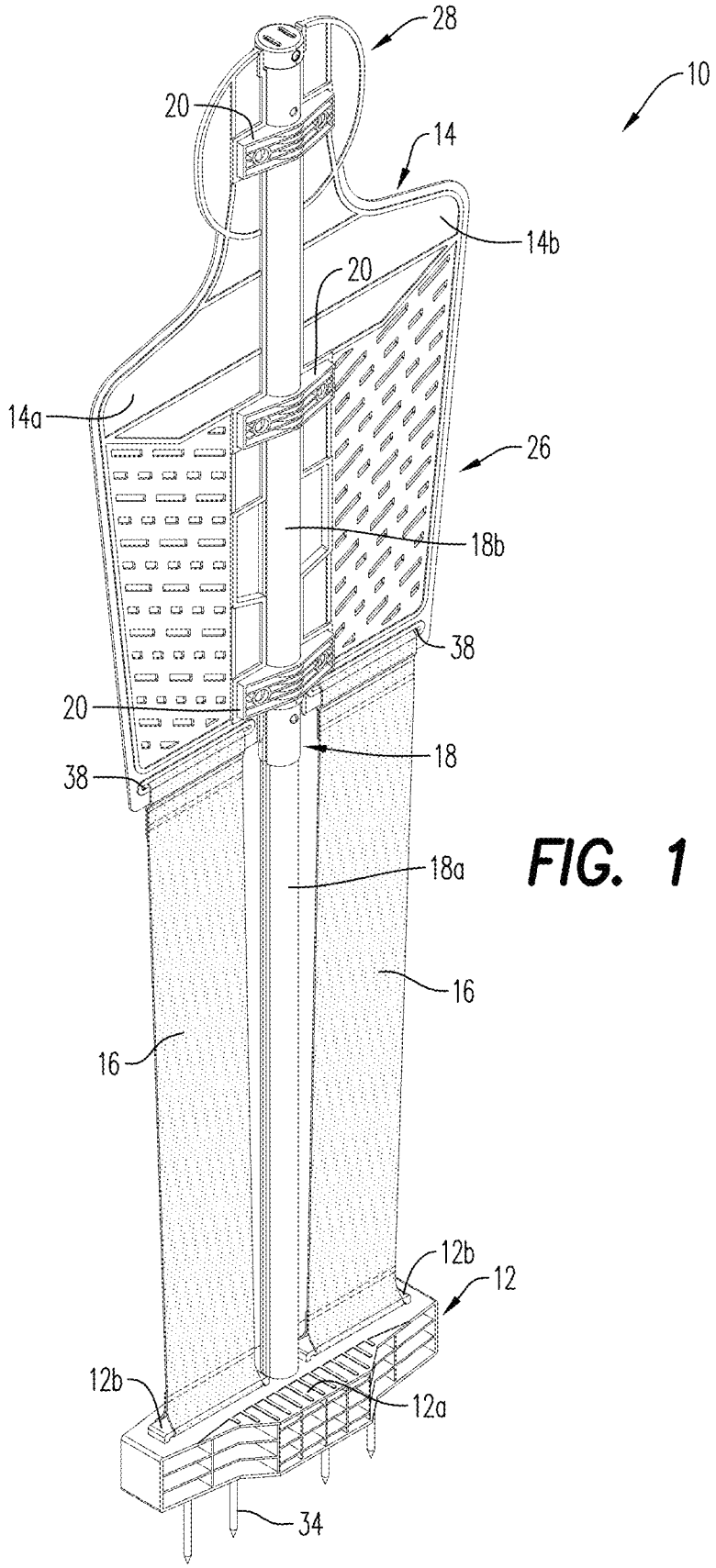
FIG. 1 is a front perspective view of a sports training aid according to an exemplary embodiment of the disclosure.
Figure 2:
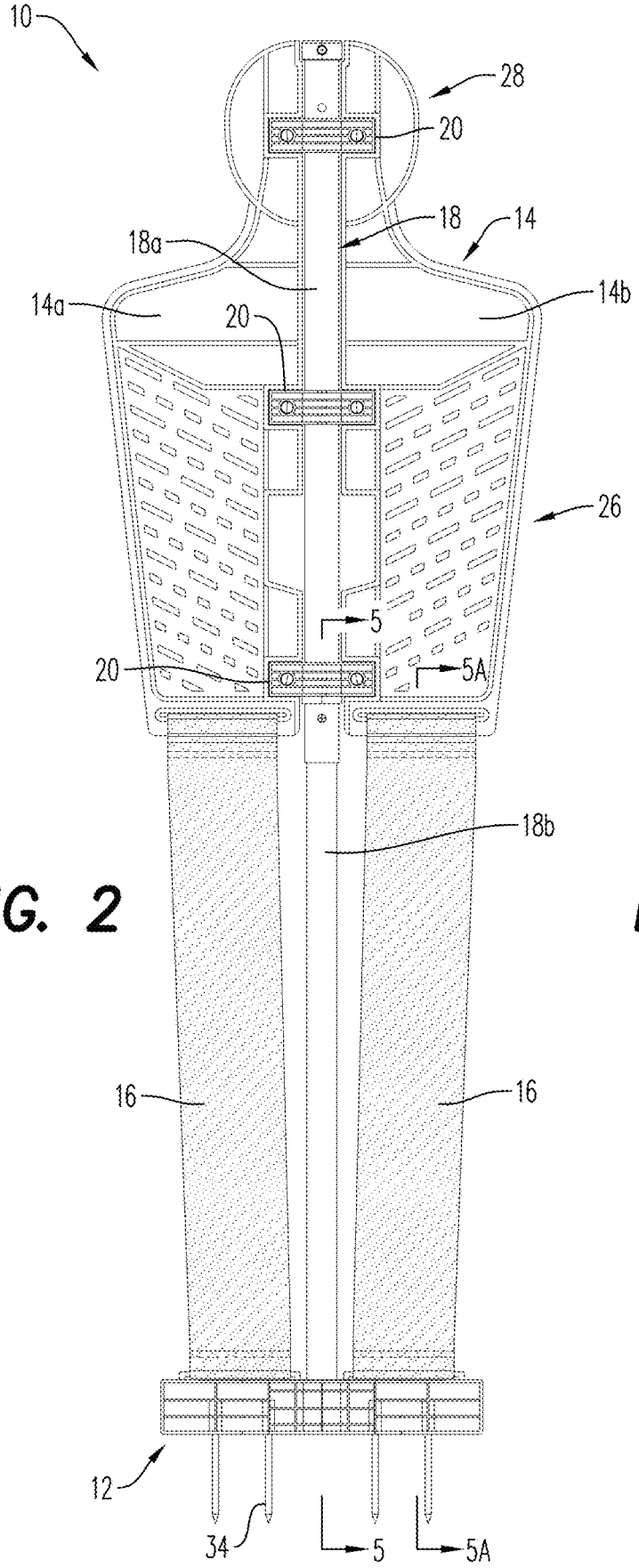
FIG. 2 is a front elevation view of the sports training aid according to an exemplary embodiment of the disclosure.
Figure 3:
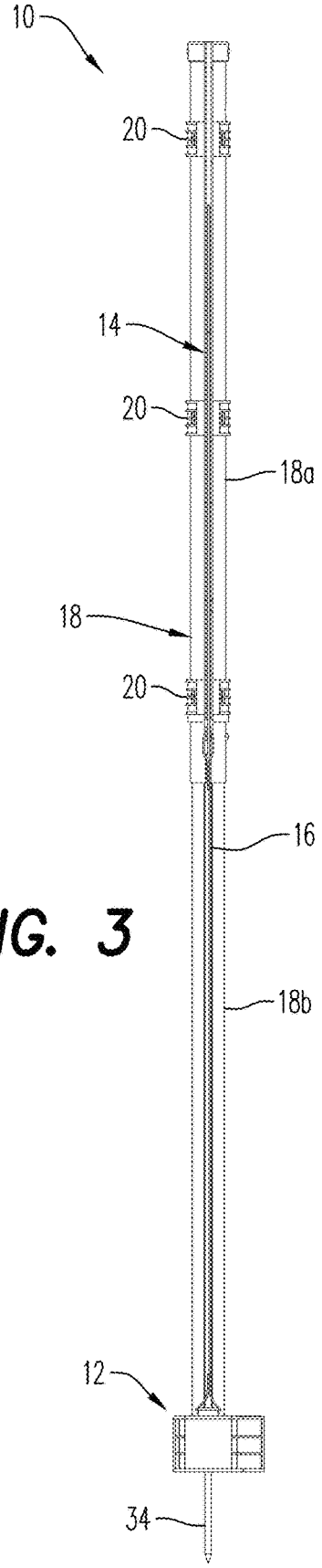
FIG. 3 is a side elevation view of the sports training aid according to an exemplary embodiment of the disclosure.
Figure 7:
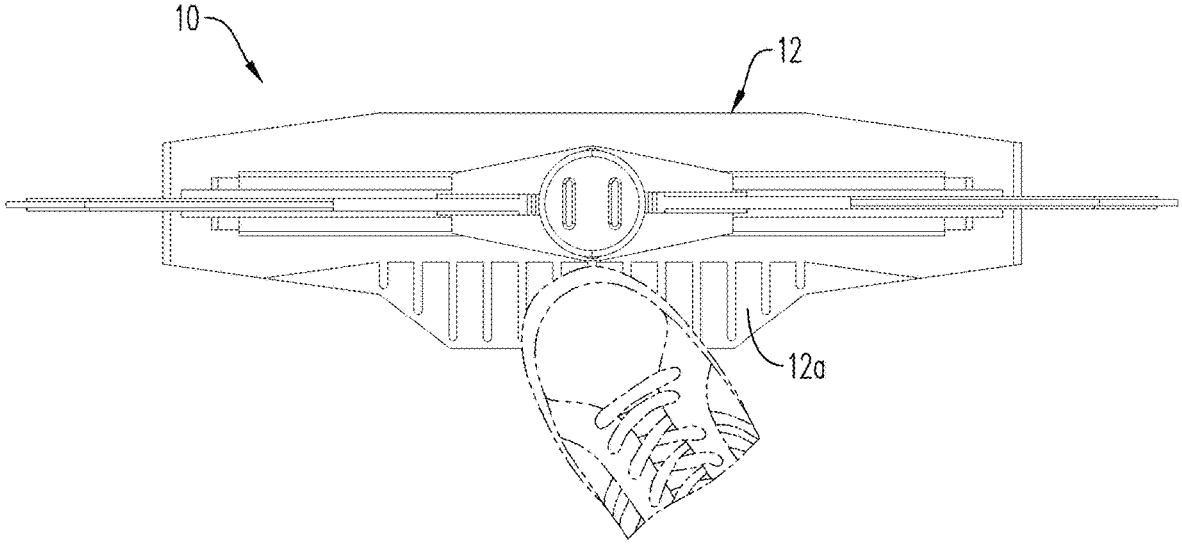
FIG. 7 is a schematic diagram illustrating the insertion of the sports training aid into a ground engaging surface according to the exemplary embodiment of the disclosure.

Referring to FIGS. 1-3, a sports training aid according to a non-limiting exemplary embodiment of the disclosure is shown generally by reference numeral 10. The sports training aid includes a base member 12, a body panel 14, and at least one elastic leg 16 extending between the base member 12 and the body panel 14. The base member 12 includes at least one and more preferably a plurality of ground stakes 34 which allow the sports training aid 10 to be erected for play on any turf playing field. In a preferred embodiment, the base member 12 further includes a projecting step portion 12*a* to facilitate a user stepping onto the base member 12 and driving the ground stakes 34 into the ground, as illustrated in FIG. 7. The base member 12 may include a polymeric material, a metallic material, or other suitable material.

Figure 5:
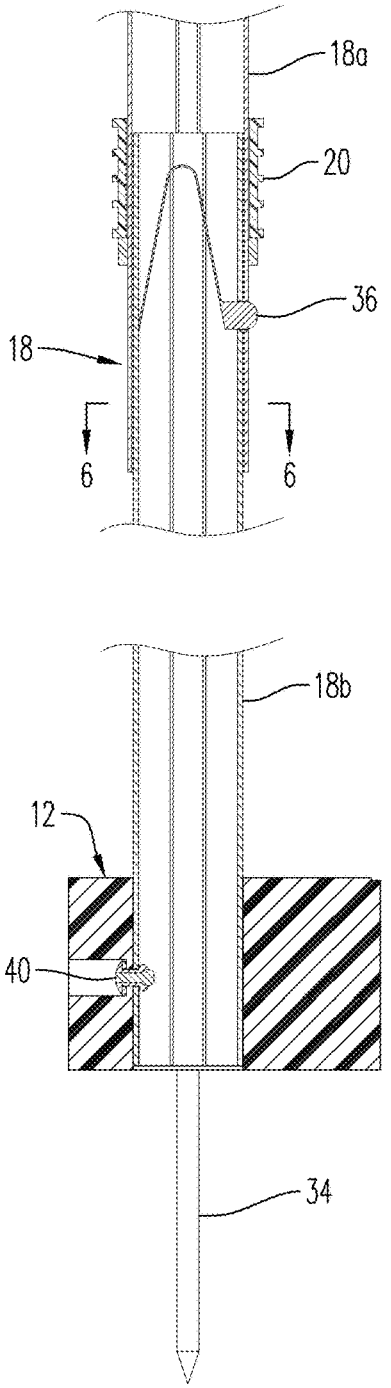
FIG. 5 is a cross-sectional view taken along the line 5-5 shown in FIG. 2.
Figure 5A:
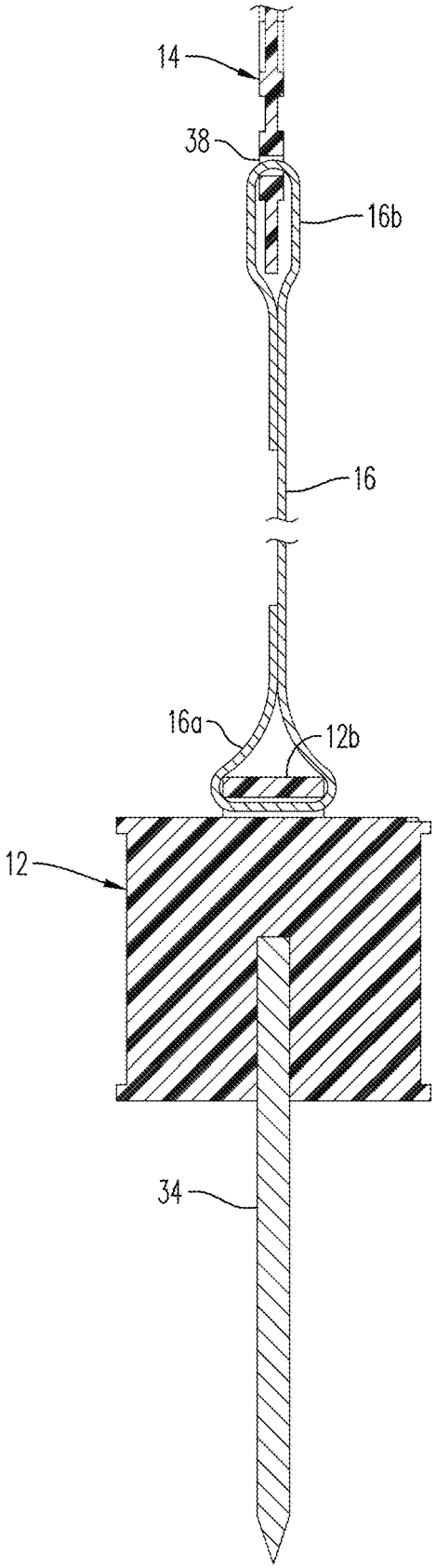
FIG. 5A is cross-sectional view taken along the line 5A-5A shown in FIG. 2.

Referring to FIGS. 1-3, in an exemplary embodiment, two elastic legs 16 are provided in order to more realistically imitate a human defender and the elastic legs 16 are preferably formed from a flexible fabric material, though other suitable materials including a flexible polymeric material may be used. As shown in FIG. 5A, a lower edge of each elastic leg 16 includes a lower loop 16*a* passing through an upper holding tab 12*b* to thereby secure the lower edge of the elastic leg to the upper surface of the base member 12. The upper edge of each elastic leg 16 similarly includes an upper loop 16*b* which passes through a through-opening 38 in an edge of body panel 14*a*, 14*b*, thereby securing the upper edge of the elastic leg 16 to the lower surface of the body panels 14*a*, 14*b*. In some aspects, the upper loop 16*b* and/or the lower loop 16*a* may comprise the same material as the elastic leg 16 or may comprise a different material. The elastic legs 16 are thus held in an outstretched manner when the sports training aid 10 is in an upright position for use, as explained further below.

Figure 8:
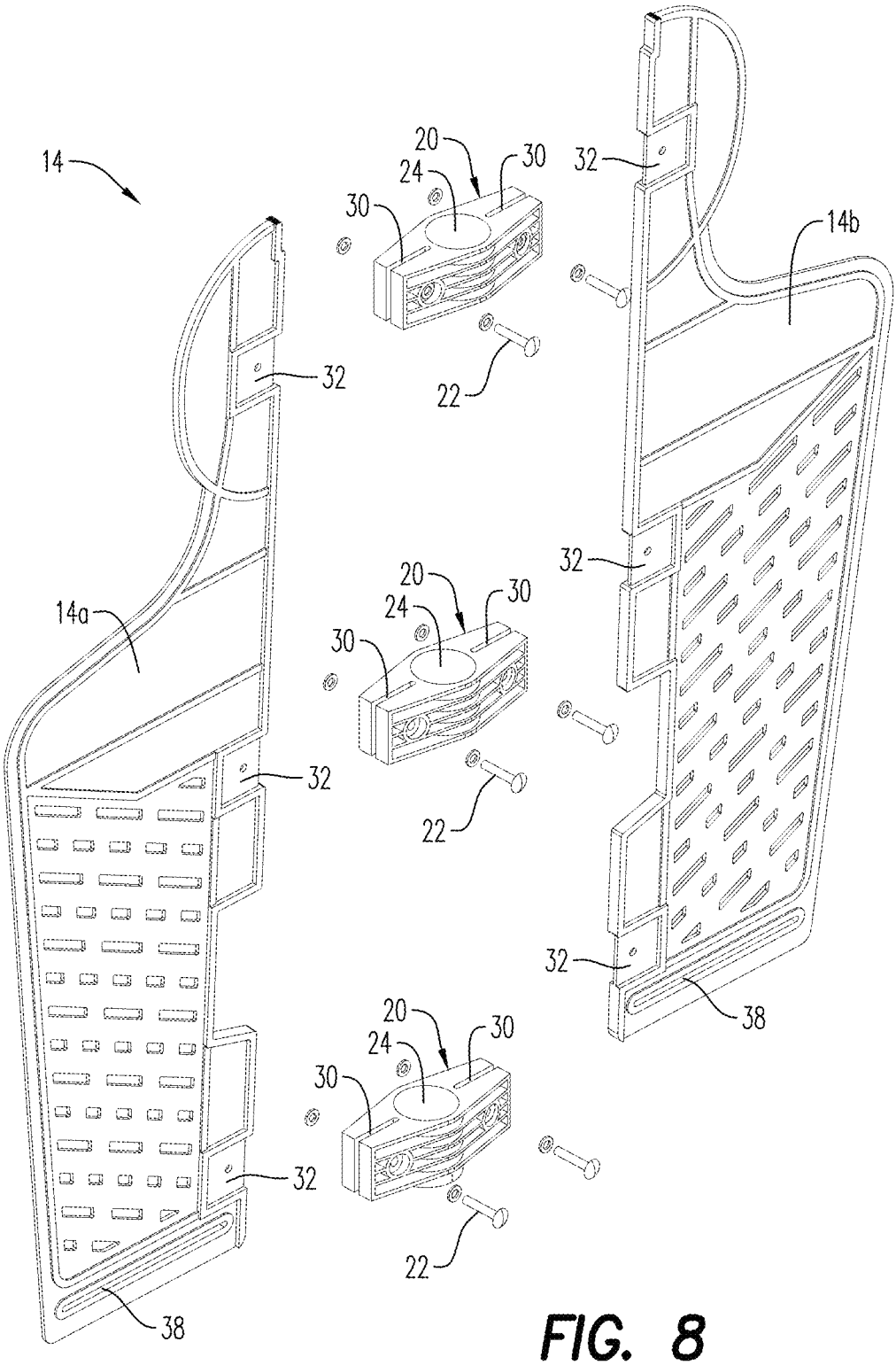
FIG. 8 is an exploded perspective view of a portion of the sports training aid according to an exemplary embodiment of the disclosure.

The body panel 14 according to the exemplary embodiment includes a first body panel 14*a* and a second body panel 14*b* which, when secured together, define a torso portion 26 and a head portion 28 configured to resemble the shape of a human defender The body panel 14 may be a rigid material, a semi-rigid material, or a flexible material. For example, in some embodiments the body panel 14 may include a fabric material, a polymeric material, a metal material, and/or other material that is suitable for defining a torso portion 26 and a head portion 28. In some aspects, the torso portion 26 and the head portion 28 may be manufactured from different materials. A plurality of clamps 20 are provided to secure together the first and second panels 14*a*, 14*b* of the body panel. According to the exemplary embodiment, and as best shown in FIG. 8, the clamps 20 include opposing slots 30 on each side thereof for receiving connecting flanges 32 formed on the first and second panels 14*a*, 14*b*. Fastening means 22 such as bolts or the like are used to tighten the clamps 20. The connecting flanges 32 are thus fixed within the slots 30 and the first and second panels 14*a*, 14*b* are thereby secured together.

Figure 6:
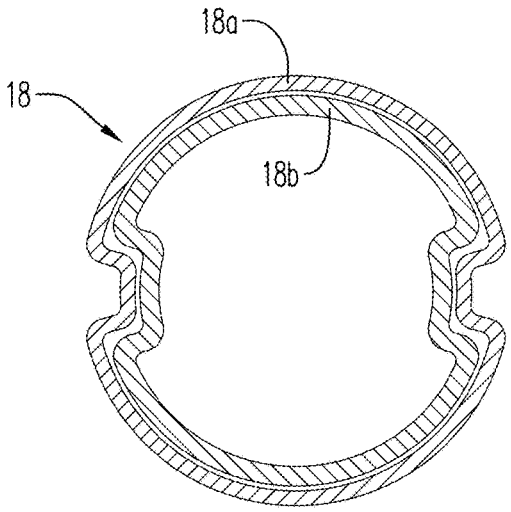
FIG. 6 is a cross-sectional view taken along the line 6-6 shown in FIG. 5.
Figure 9:
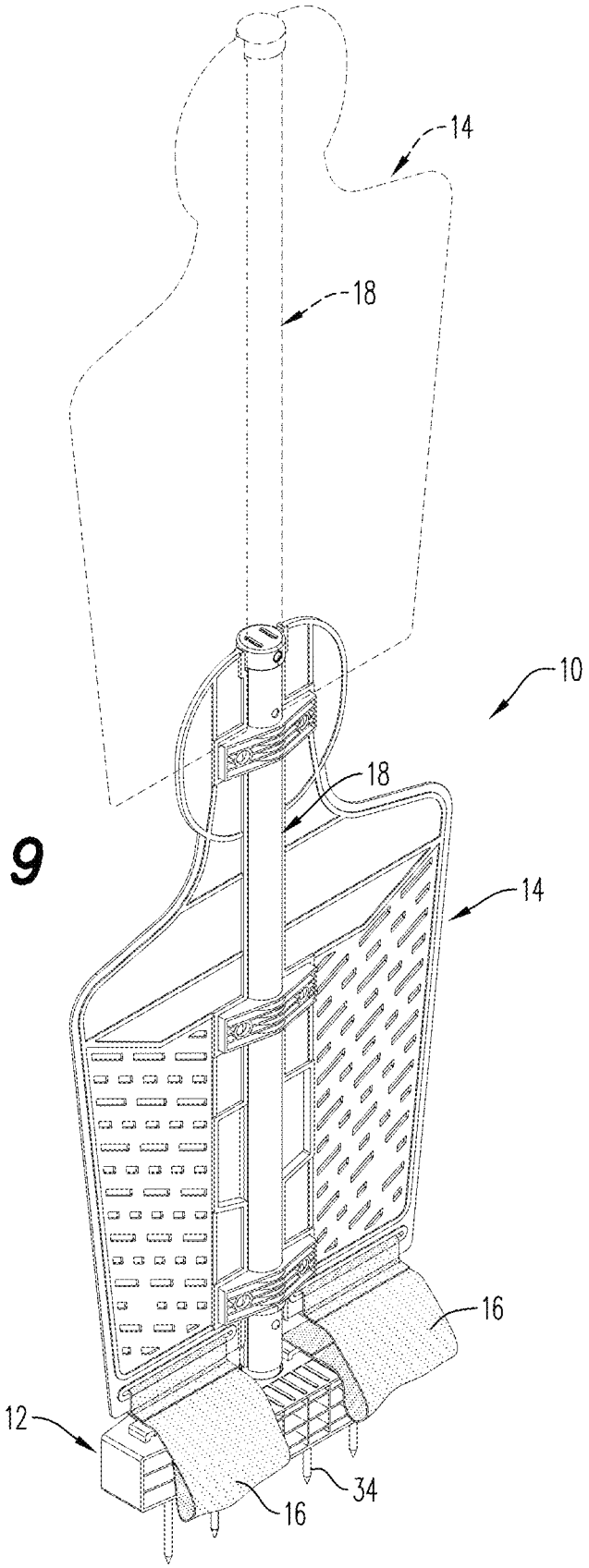
FIG. 9 is a perspective view of the sports training aid according to an exemplary embodiment of the disclosure in a collapsed state.

As shown for example in the embodiment depicted in FIGS. 1-5, the sports training aid 10 further includes a center pole 18 extending from the base member 12 to the head portion 28 of the body panel 14, and secured to the base member 12 by a screw 40 or other fastening mechanism. The clamps 20 include a through hole 24 which allows the center pole 18 to extend there through. In the exemplary embodiment, as shown in FIGS. 6 and 9, the center pole 18 includes a plurality of telescopic poles 18*a*, 18*b* which allows the soccer training aid 10 to collapse to a smaller overall height for ease of transport and storage when the telescopic poles 18*a*, 18*b* are nested one within the other. The center pole 18 may be formed of a polymeric material, a metallic material, or other suitable material. A locking detent button 36 (see FIG. 5), or other similar mechanism, may be provided on the center pole 18 such that the center pole 18 can be secured in the extended upright position during use, and then released into the collapsed position for transport or storage.

Figures 4A, 4B, 4C, 4D:
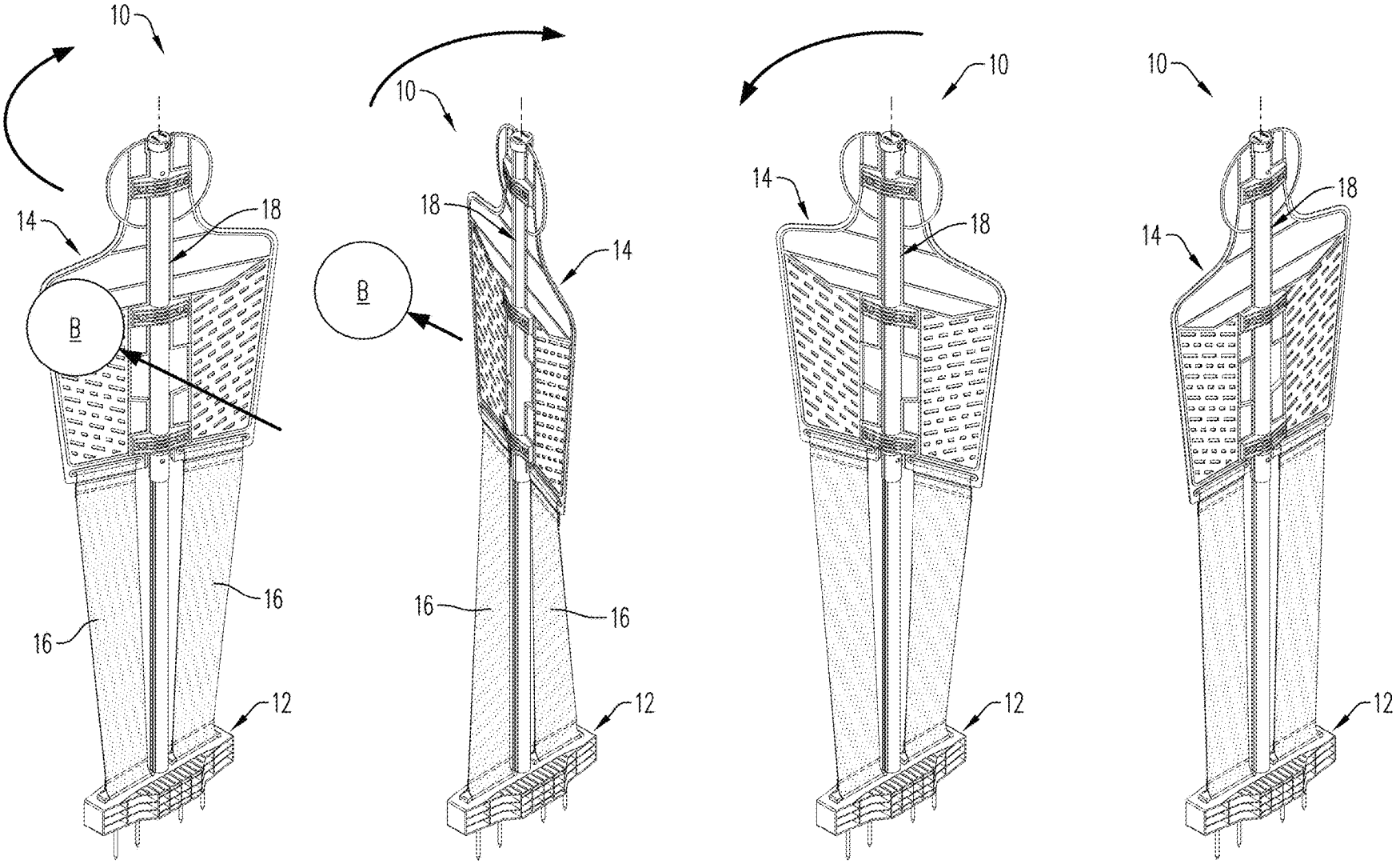
FIGS. 4A-4D are schematic diagrams illustrating the movement of the sports training aid according to the exemplary embodiment of the disclosure when impacted by a sports ball.

With reference to FIGS. 4A-4B, the body panel 14 is able to deflect and rotate around the center pole 18 when impacted by a ball B, such as a soccer ball, due to the rigidity of the body panel 14 and the elastic nature of the elastic legs 16. The panel 14 can rotate/spin multiple times completely around the center pole 18 when impacted by the ball B, whereby the elastic legs 16 are twisted several times over (not shown). This is not a concern however because, due to the elastic legs 16, body panel 14 will return to its original position by rotating in the opposite direction once the force that caused the deflection has subsided or otherwise been removed, as schematically shown in FIGS. 4C-4D. Thus, the ability of the sports training aid 10 to move and deflect in response to the impact from a ball B, such as a soccer ball, better imitates a human defender during practice.

Although certain exemplary embodiments of the disclosure have been shown and described in detail, it should be understood that various changes and modifications may be made therein without departing from the scope of the appended claims.

What is claimed is:

1. A sports training aid comprising:

a base member;

a center pole secured to the base member;

at least one body panel rotatably secured to the center pole; and a plurality of elastic legs connected between the at least one body panel and the base member, wherein the at least one body panel is configured to rotate in a first direction about the center pole when impacted by an object, the at least one body panel rotating from an original position to a deflected position, and wherein the elastic legs are configured to cause the at least one body panel to rotate in a second direction, opposite to the first direction, when a force from the impaction subsides, thereby returning the at least one body panel to the original position.

2. The sports training aid according to claim 1, wherein the at least one body panel includes a first body panel and a second body panel.

3. The sports training aid according to claim 2, further comprising a plurality of clamps configured to secure the first body panel together with the second body panel, the plurality of clamps including a through opening for the center pole extending therethrough.

4. The sports training aid according to claim 3, wherein the first body panel and the second body panel each include at least one connecting flange.

5. The sports training aid according to claim 4, wherein the plurality of clamps include a slot on each opposing end, the slot on one end of the clamp configured to receive a corresponding one of the connecting flanges on the first body panel and the slot on the other end of the clamp configured to receive a corresponding one of the connecting flanges on the second body panel, whereby the plurality of clamps secure together the first body panel and the second body panel.

6. The sports training aid according to claim 1, wherein the at least one body panel is configured to have a shape resembling a human torso and a human head.

7. The sports training aid according to claim 1, wherein the plurality of elastic legs rotate and twist around the center pole in the first direction when the at least one body panel is impacted by the object.

8. The sports training aid according to claim 7, wherein the plurality of elastic legs rotate and untwist around the center pole in the second direction, opposite to the first direction, when the force from the impact subsides.

9. The sports training aid according to claim 1, wherein the center pole comprises a plurality of telescoping poles such that an overall height of the sports training aid can be reduced when the plurality of telescoping poles are collapsed.

10. The sports training aid according to claim 9, wherein the center pole includes a detent button to secure the plurality of telescoping poles in an extended configuration, said detent button being released to collapse the plurality of telescoping poles into a collapsed configuration.

11. The sports training aid according to claim 1, wherein the base member includes a projecting step member and at least one ground stake.

12. The sports training aid according to claim 1, wherein the at least one body panel includes a through opening for receiving at least one of said plurality of elastic legs such that an upper edge of the at least one of said plurality of elastic legs is secured to the at least one body panel.

13. The sports training aid according to claim 1, wherein the base member includes a holding tab for receiving at least one of said plurality of elastic legs such that a lower edge of the at least one of said plurality of elastic legs is secured to the base member.

14. The sports training aid according to claim 1, wherein the at least one body panel is configured to rotate in the first direction at least one hundred eighty degrees about the center pole when impacted by the object.

15. The sports training aid according to claim 14, wherein the at least one body panel is configured to rotate in the first direction at least three hundred sixty degrees about the center pole when impacted by the object.

* * * * *